US007851686B1

(12) United States Patent
Davidson

(10) Patent No.: US 7,851,686 B1
(45) Date of Patent: Dec. 14, 2010

(54) TUNING A MUSICAL INSTRUMENT

(76) Inventor: Benjamin Davidson, 38 Harriman Rd., Hudson, MA (US) 01749

( * ) Notice: Subject to any disclaimer, the term of this patent is extended or adjusted under 35 U.S.C. 154(b) by 0 days.

(21) Appl. No.: 12/556,228

(22) Filed: Sep. 9, 2009

(51) Int. Cl.
*G10G 7/02* (2006.01)

(52) U.S. Cl. ..... 84/454

(58) Field of Classification Search ..... 84/454
See application file for complete search history.

(56) References Cited

U.S. PATENT DOCUMENTS

| | | | | | |
|---|---|---|---|---|---|
| 2,072,043 | A * | 2/1937 | Stover | ..... | 84/454 |
| 2,571,979 | A * | 10/1951 | Webster | ..... | 73/648 |
| 3,456,062 | A * | 7/1969 | Watson et al. | ..... | 84/672 |
| 3,795,169 | A * | 3/1974 | Belcher | ..... | 84/454 |
| 4,453,448 | A * | 6/1984 | Miesak | ..... | 84/454 |
| 4,584,923 | A * | 4/1986 | Minnick | ..... | 84/454 |
| 4,803,908 | A * | 2/1989 | Skinn et al. | ..... | 84/454 |
| 4,909,126 | A * | 3/1990 | Skinn et al. | ..... | 84/454 |
| 5,009,142 | A * | 4/1991 | Kurtz | ..... | 84/454 |
| 5,390,579 | A * | 2/1995 | Burgon | ..... | 84/454 |
| 5,808,218 | A * | 9/1998 | Grace | ..... | 84/456 |
| 6,836,056 | B2 * | 12/2004 | Oudshoorn et al. | ..... | 310/328 |
| 7,595,443 | B2 * | 9/2009 | Yagi | ..... | 84/600 |
| 2005/0005759 | A1 * | 1/2005 | Dulaney et al. | ..... | 84/394 |
| 2006/0075875 | A1 * | 4/2006 | Membreno et al. | ..... | 84/394 |
| 2007/0095196 | A1 * | 5/2007 | Yagi et al. | ..... | 84/612 |

OTHER PUBLICATIONS

Gibson USA Owner's Manual, http://www.gibson.com/robotguitar/robot-guitar-manual.pdf, Undated.

* cited by examiner

*Primary Examiner*—Elvin G Enad
*Assistant Examiner*—Robert W Horn
(74) *Attorney, Agent, or Firm*—Fish & Richardson P.C.; Frank L. Gerratana

(57) ABSTRACT

Among other things, a tuning device is used with a musical wind instrument. The tuning device includes a linear actuator, a first mounting assembly attached to the linear actuator and adapted for releasable mounting to the first portion of the musical wind instrument to be tuned, a second mounting assembly attached to the linear actuator and adapted for releasable mounting to the second portion of the musical wind instrument to be tuned, a sensor for a frequency of a note played on the musical wind instrument, a comparator of the played frequency to a reference frequency, and a transmitter for issuing a movement signal to the linear actuator for changing spacing between the first and second mounting assemblies to adjust relationship between first and second tubular portions, and for ceasing the movement signal when the comparator determines that the played frequency has approximately matched the reference frequency.

18 Claims, 11 Drawing Sheets

TUNING A MUSICAL INSTRUMENT

BACKGROUND

This specification relates to tuners and tuning a musical instrument.

Musical instruments emit sounds in the form of musical notes that correspond to frequencies audible to the human ear. When a musician plays a note on a particular instrument, the note may vary in sound wave frequency depending on the technique of the musician and the configuration or adjustment of the instrument. In order for the music resulting from the musician's performance to correctly reflect the intentions of the musician and the composer, a musical instrument must produce notes at the proper or expected frequencies. Similarly, when multiple musicians perform together in an ensemble or orchestra, their instruments must be properly adjusted or tuned in order to produce notes of proper frequency when simultaneously performing the same piece of music. To maintain proper tuning, it may be necessary for a musician to alter or adjust the configuration of the musical instrument before or during every session, in order to ensure that it properly produces notes of the intended frequencies.

SUMMARY

In a general aspect, a tuning device is used with a musical wind instrument that has a first tubular portion and second tubular portion, together defining a musical air passage and disposed in a mutually adjustable relationship for establishing tuning status. The tuning device includes a linear actuator, a first mounting assembly attached to the linear actuator and adapted for releasable mounting to the first portion of the musical wind instrument to be tuned, a second mounting assembly attached to the linear actuator and adapted for releasable mounting to the second portion of the musical wind instrument to be tuned, a sensor for a frequency of a note played on the musical wind instrument, a comparator of the played frequency to a reference frequency, and a transmitter for issuing a movement signal to the linear actuator for changing spacing between the first and second mounting assemblies to adjust relationship between first and second tubular portions, and for ceasing the movement signal when the comparator determines that the played frequency has approximately matched the reference frequency.

Implementations of this aspect can include one or more of the following features. The musical wind instrument may be a flute. The first mounting assembly may include a first quick-release clamp and the second mounting assembly may include a second quick-release clamp. The reference frequency may be acquired from another musical instrument. The reference frequency may be selected on a user interface. The transmitter may issue the movement signal for a period of time to alter the frequency of the played note received by the sensor. The period of time may be calculated using the difference between the frequency of the musical note and the reference frequency. The transmitter may issue the movement signal and cease the movement signal more than once.

In a general aspect, a method is used for tuning a musical wind instrument that has a first tubular portion and second tubular portion, together defining a musical air passage and disposed in a mutually adjustable relationship for establishing tuning status. The method includes releasably mounting a first mounting assembly attached to the linear actuator to the first portion of the musical wind instrument to be tuned, releasably mounting a second mounting assembly attached to the linear actuator to the second portion of the musical wind instrument to be tuned, sensing a frequency of a note played on the musical wind instrument, comparing the played frequency to a reference frequency, issuing a movement signal to the linear actuator to change spacing between the first and second mounting assemblies to adjust relationship between first and second tubular portions, and ceasing the movement signal when the comparator determines that the played frequency has approximately matched the reference frequency.

Implementations of this aspect can include one or more of the following features. The musical wind instrument may be a flute. Releasably mounting a first mounting assembly to the first portion of the musical wind instrument may include mounting the first portion to a first quick-release clamp, and releasably mounting a second mounting assembly to the second portion of the musical wind instrument may include mounting the second portion to a second quick-release clamp. The method may include sensing a frequency of a reference note played on a musical instrument not mounted to the tuning device, and using the frequency of the reference note as the reference frequency. The method may include selecting the reference frequency on a user interface. Issuing the movement signal may include issuing the movement signal for a period of time. The method may include calculating the period of time using the difference between the frequency of the played note and the reference frequency. Issuing the movement signal may include issuing the movement signal more than once.

In a general aspect, a computer-readable medium stores a computer program for tuning a musical instrument. The computer program includes instructions for causing a computer to sense a frequency of a note played on a musical instrument to be tuned, a first portion of the musical instrument releasably mounted to a first mounting assembly and a second portion of the musical instrument releasably mounted to a second mounting assembly, both assemblies attached to a linear actuator, compare the played frequency to a reference frequency, issue a movement signal to the linear actuator to change spacing between the first and second mounting assemblies to adjust relationship between first and second tubular portions, and cease the movement signal when the comparator determines that the played frequency has approximately matched the reference frequency.

Implementations of this aspect can include the feature of the computer-readable medium storing a computer program for tuning the musical instrument, where the computer program includes instructions for causing a computer to tune a musical wind instrument.

Aspects can include one or more of the following advantages. The tuning device can be used to tune a musical instrument quickly, easily, and accurately, even if the person tuning the instrument is relatively unskilled or otherwise lacking in ability. The tuning device can be adapted for use with a variety of wind and other musical instruments.

Other features and advantages will become apparent from the following description, and from the claims.

DESCRIPTION

Figure 1A:
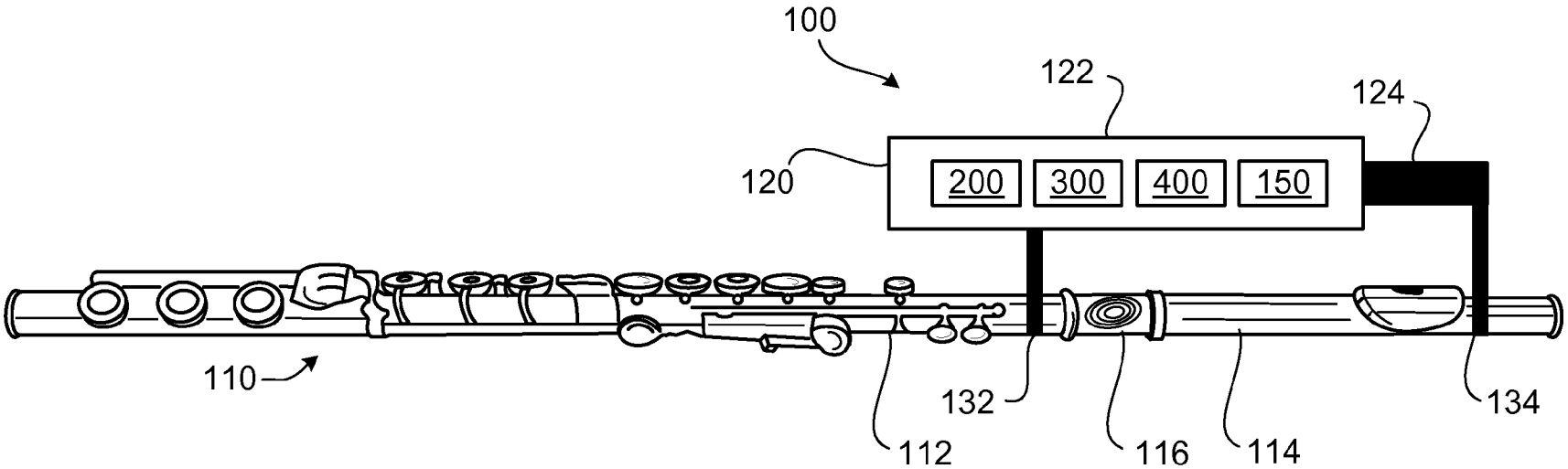
FIG. 1A is a flute tuning device of the disclosure.

A musical instrument in the musical wind instrument family, such as a flute, produces sound when an air-jet flows through the instrument. In use, a musician places the instrument close to his or her lips and produces the air jet by compression and expansion of the diaphragm. The air-jet is projected across and into the aperture of a mouthpiece. The instrument itself produces vibrations of the air perceived as sound by the human ear.

Sound can be characterized in several different ways. A pure tone only contains one frequency and can be represented with a single sine wave. When the air inside an open tube vibrates, the resulting fundamental frequency is proportional to twice the entire length of the tube. In addition, the air vibrates at the full length of the tube, half the length, one third the length, and so on. The shorter vibration lengths correspond to the integers of a harmonic series. A musical wind instrument like a flute can be considered a tube that is open at both ends.

A modern Boehm-system flute has keys and acoustically-spaced tonal apertures. Using different fingerings, a musician can change the effective length of the flute to produce a change in pitch. Some factors that affect the tonality of the flute include temperature, air-jet speed, air-jet angle, lip-height, embouchure coverage, cork position, and head joint length.

Musical notes can be considered in tune when they have identical frequency. The variables that affect the tuning of a musical wind instrument like a flute fall under the categories of the environment, the player, and the instrument. One environmental variable that affects a flute, for example, is the temperature. As the temperature increases, the flute tends to become sharp; conversely, as the temperature decreases, the flute tends to become flat.

Other factors that affect the tuning of the flute are player variables. The loudness of the note affects the tuning and can be changed by increasing both the velocity of the air-jet and the flute aperture size, which is controlled by the position of the player's lip. The air jet angle also affects the tuning and can be changed by altering the direction of the lips or by rolling the flute inward or outward. Other factors include lip opening and lip height.

The last category of variables that affects the tuning of a flute is the configuration of the flute itself. A flute is typically made up of two sections, the head joint and the body. These sections can move in relation to each other, changing the configuration of the instrument. As a result, the distance from the head joint to the body is a variable that affects the tuning. By increasing this distance, the sound emitted from flute lowers in frequency, becoming flatter. Musicians intentionally adjust this distance in order to be in tune with the rest of an ensemble and to correct any movement of the two sections that may occur in use and handling of the instrument.

FIG. 1 shows a tuning device 100 mounted for tuning a musical instrument 110, which in this case is a musical wind instrument. For the purpose of illustration, the musical instrument 110 shown is a flute. The tuning device 100 has a linear actuator 120 having a body 122 and a piston 124. The tuning device tunes the instrument by moving the piston inward or outward, altering the configuration of the musical instrument until it plays a musical note at the proper frequency. The tuning device 100 also has a digital control circuit 200, an audio input circuit 300, and a mechanical interface circuit 400. The digital control circuit 200 uses the audio input circuit 300 to acquire a sound played by the instrument, and uses the mechanical interface circuit 400 to control the linear actuator 120.

The linear actuator is connected to the instrument using two attachment devices 132, 134. One attachment device 132 is connected to the body 122 of the linear actuator, and one attachment device 134 is connected to the piston 124 of the linear actuator. Here, the attachment devices 132, 134 are round or circumferential clamps, which tightly grip about the instrument. The instrument has at least two sections 112, 114 attached at a mobile junction 116. One attachment device 132 grips the instrument at the first section 112, and the second attachment device 134 grips the instrument at the second section 114.

When the linear actuator 120 moves the piston 124 inward or outward relative to the body 122, the two attachment devices 132, 134 move closer to each other or away from each other. If the attachment devices are attached to the instrument 110, then the movement of the piston 124 causes the second attachment device 134 to move farther from or closer to the first attachment device 132. This movement of the attachment devices changes the configuration of the two sections 112, 114 of the instrument. For example, the first section 112 of the instrument can telescope out from or into the second section 114. When the piston 124 moves outward, the second section slides out from the first section, which changes the configuration of the instrument and affects the frequency of the sound when the instrument is played. For example, if the instrument is a flute and the first section is the head joint of the flute, then inward movement of the head joint increases and frequency, and outward movement of the head joint decreases the frequency. Musicians use the terminology "sharper" to mean an increase of frequency and "flatter" to mean a decrease in frequency.

The linear actuator 120 is capable of applying sufficient force to the piston 124 to move the first section 112 in relation to the second section 114. For example, if the musical instrument 110 is a flute, the first section 112 is the head joint and the second section 114 is the body. In this example, to move the head joint away from the body, the linear actuator might apply a force between approximately 18 and 33 Newtons. To move the head joint toward the body, the linear actuator might apply a force between approximately 18 and 29 Newtons. Continuing with this example, the actual force that the linear actuator applies varies depending on the type of flute, but a linear actuator capable of applying at least between 35 and 67 Newtons can properly manipulate the configuration of a flute. If the linear actuator is manipulating another type of musical instrument 110 then the linear actuator may be capable of applying force in a different range of greater or lesser magnitude.

Different implementations of the tuning device 100 might each use a different version of linear actuator, of which there are many types and variations. The linear actuator can be any device capable of applying linear force. In some implementations, a device other than a conventional linear actuator is used to manipulate the musical instrument 110. Instead, another device capable of applying a force that changes the configuration of the musical instrument might be used.

The attachment devices 132, 134 may take different forms depending on the type of musical instrument 110 used with the tuning device 100. For example, if the musical instrument 110 is a string instrument, at least one of the sections 112, 114 of the instrument might be a string, and at least one of the attachment devices 132, 134 might be adapted to attach to a string. In some implementations, the tuning device 100 might have more than two attachment devices.

The tuning device 100 also has a user interface 150 for manipulating the functions of the device.

Figure 1B:
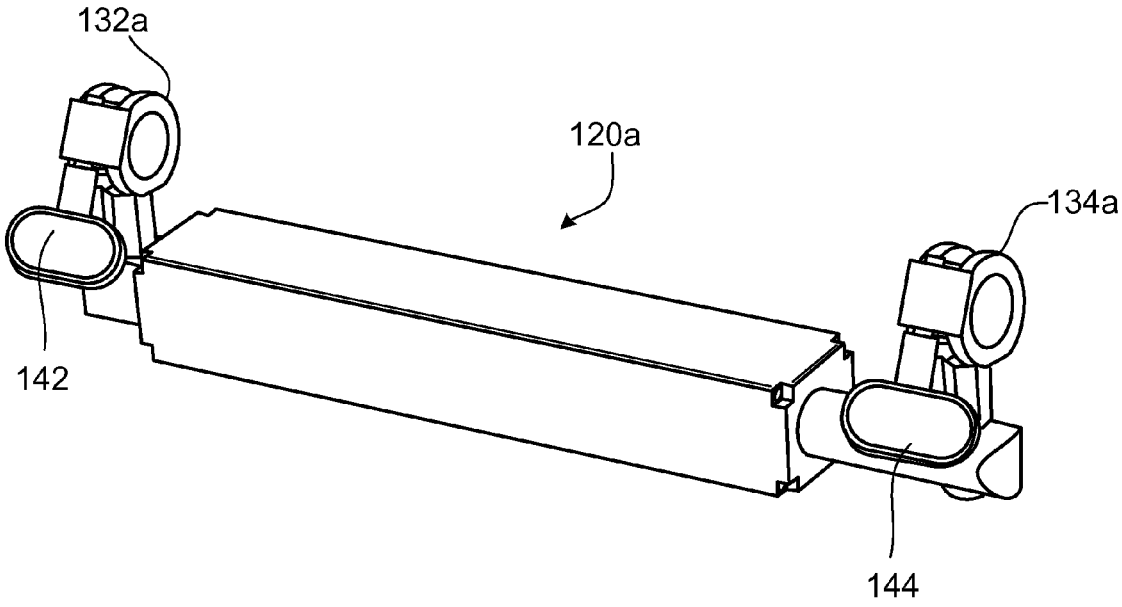
FIG. 1B is a linear actuator and clamp assembly of the flute tuning device of FIG. 1A.

FIG. 1B shows one version of the linear actuator 120*a* that can be used with the tuning device, including a body 122*a* and piston 124*a*. This linear actuator 120*a* has attachment devices in the form, e.g., of cushioned hose clamps 132*a*, 134*a*, which are suitable for a musical instrument 110 that is cylindrical, such as a flute. In use, a musician inserts the musical instrument 110 into the hose clamps 132*a*, 134*a*. The hose clamps 132*a*, 134*a* have wing nuts 142, 144 that a musician can use to tightly and secure a musical instrument to the linear actuator 120*a*.

Figure 1C:
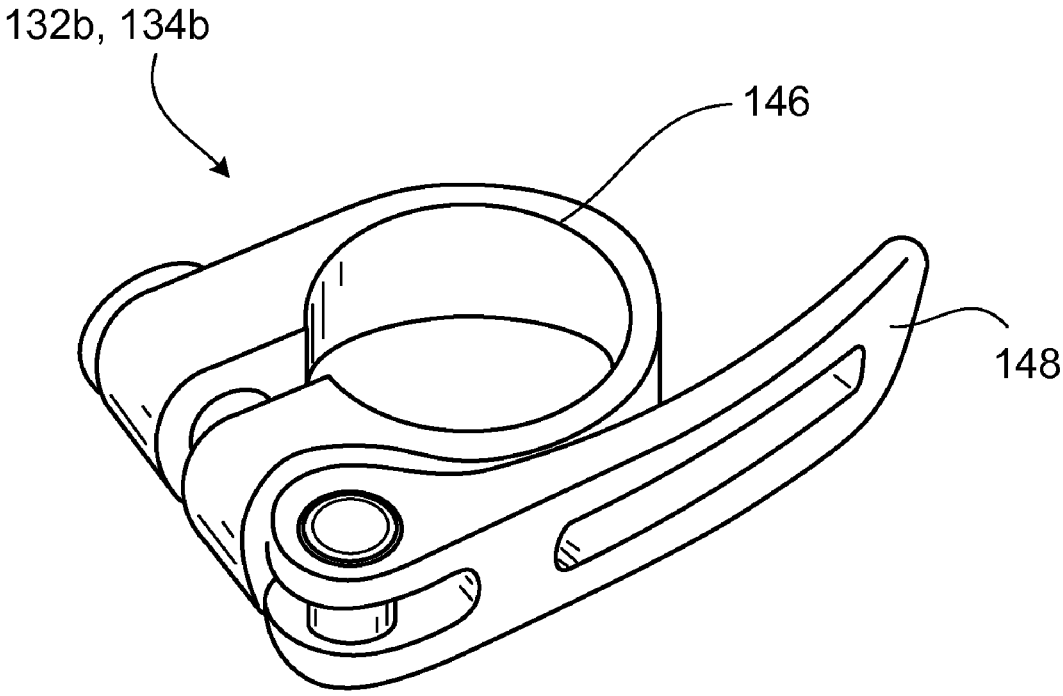
FIG. 1C is a clamp assembly of the flute tuning device of FIG. 1A.

Other types of attachment devices can also be used. FIG. 1C shows another type of attachment device 132*b*, 134*b* in the form of a clamp 146 with a quick-release handle 148. In use, a musician opens the clamp 146 on each attachment device 132*a*, 134*b* using the handle 148, slides the musical instrument 110 in each clamp, and presses down on each handle, securing the musical instrument. This type of clamp 146 allows the tuning device 100 to be mounted and dismounted to a musical instrument more quickly and efficiently in an environment where multiple musicians are using the tuning device, such as a band or orchestra environment. Any similar clamp with an over-the-center or quick-release handle can provide the same functionality.

Figure 1D:
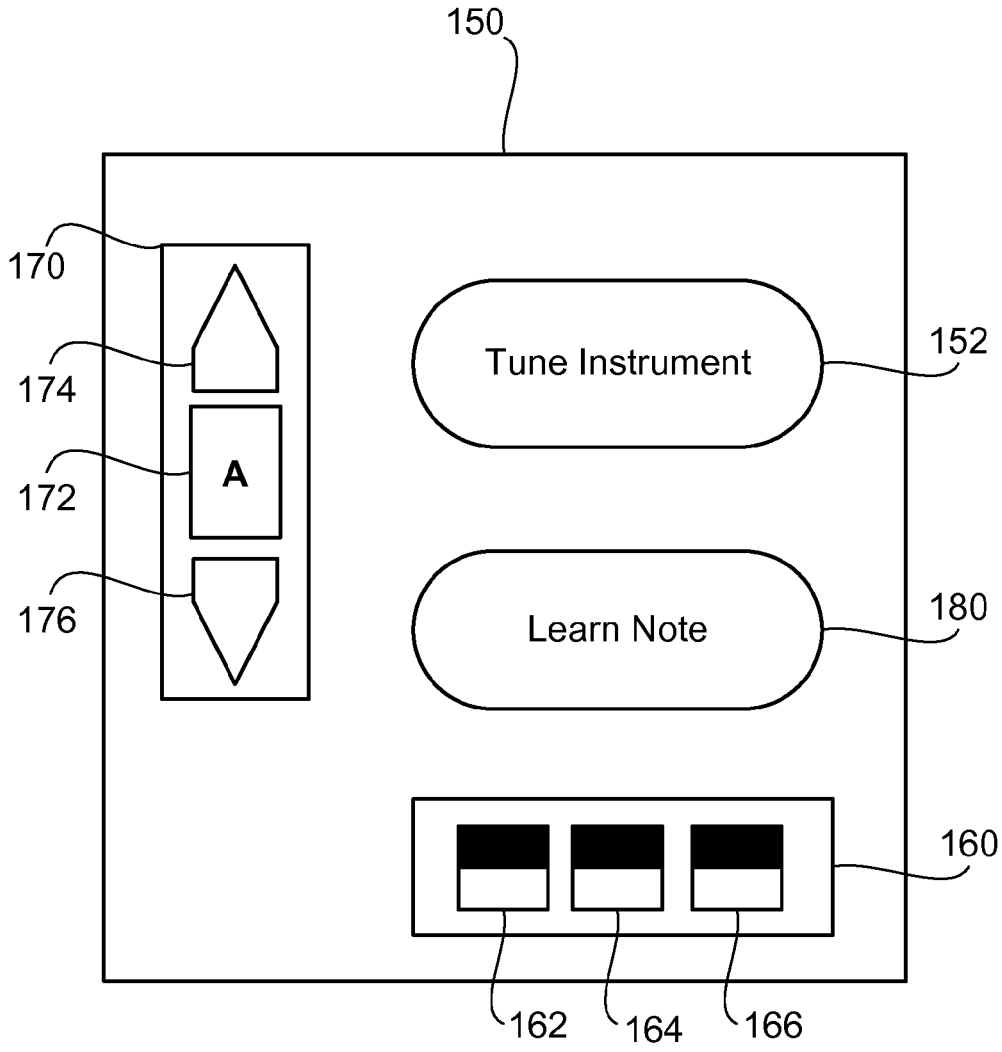
FIG. 1D is a user interface for the flute tuning device of FIG. 1A.

FIG. 1D shows the user interface 150. The user interface 150 has a tune button 152 that a musician can press to tune the musical instrument 110. The tune button 152 is in communication with the digital control circuit 200 so that when the musician presses the button, the digital control circuit 200 commences its tuning operations, including acquiring the sound played by the instrument and manipulating the linear actuator 120 to adjust the instrument configuration. The user interface 150 may be integrated with the tuning device 100, or the user interface may be part of an external component in communication with the tuning device. For example, the user interface might be an accessory device that can be tethered to the tuning device 100 by a wire or wirelessly, or the user interface might be implemented as a software program on a computer that transmits and receives signals to and from the tuning device 100.

In some implementations, the user interface 150 also has an indicator display 160 providing feedback to the musician. For example, the indicator display might have lights 162, 164, 166 that show patterns indicating the status of the tuning device 100. One pattern might indicate that the device is initializing. Another pattern might indicate that the musician should begin playing the instrument. Another pattern might indicate that the instrument is playing a "flat" note and that the linear actuator is adjusting the instrument's configuration. Another pattern might indicate the same for a "sharp" note. Another pattern might indicate that the instrument is playing a note outside the frequency range expected by the tuning device. Another pattern might indicate that the instrument has been fully tuned. Any of these patterns might use different lights or different light colors. Further, the indicator display 160 need not be lights, but could also be a display capable of showing numbers or text. The indicator display 160 could also generate sound, either in place of or in addition to visual indicators.

In some implementations, the user interface has a note selector 170. The note selector 170 allows the musician to choose a note to play on the musical instrument 110, which the tuning device 100 evaluates to determine whether or not the musical instrument is generating the proper frequency for that note. For example, the note selector might have a note display 172 showing the currently-selected musical note, and selector keys 174, 176 that the musician can use to select a different note. The tuning device 100 might have a default note, such as "A," the note used often in tuning an instrument. However, if the musician wants to tune the instrument's output of other notes, such as "B," "C," and so on, the musician has the option of selecting a different note with the selector keys 174, 176, upon which other note options will appear on the note display 172.

In some implementations, the user interface has a learn note button 180. The note learn button 180 allows the musician to play a note on one musical instrument and then use the tuning device 100 to tune another musical instrument to that note. For example, in symphony, the reference signal would typically be played or recorded by the 1$^{st}$ chair performer, and everyone else would tune their instrument to match that frequency. In use, the musician can press the learn note button 180 and play a note on the first musical instrument. During this time, the second musical instrument can be attached to the tuning device 100, or the second musical instrument can be attached after the first musical instrument is played. Once the tuning device has determined the frequency of the note, the musician uses the tune button 152 to tune the instrument so that it plays a note at the same frequency as did the first musical instrument. The learn note button 180 might work with the indicator display 160 to indicate to the musician when to play a note on the first musical instrument and when the tuning device 100 has learned the frequency of the note so that the second musical instrument can be tuned.

In some implementations, the user interface provides other configuration options. For example, the user interface might have controls for selecting the clef or key of the instrument to be tuned.

Figure 2:
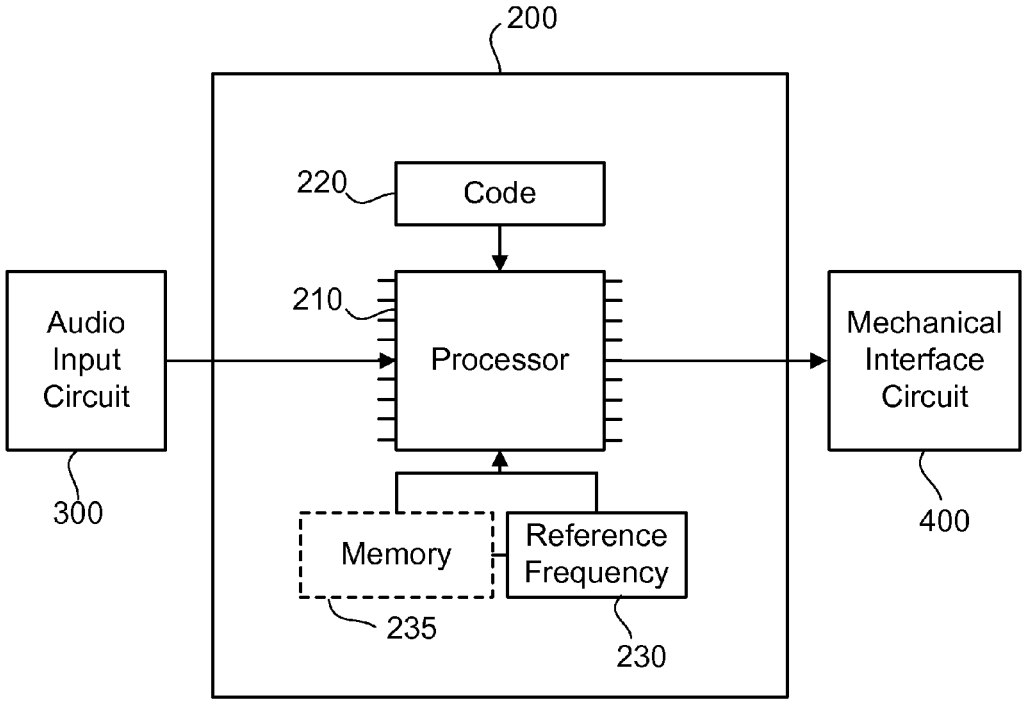
FIG. 2 is a block diagram of a digital control circuit

FIG. 2 shows the digital control circuit 200, which has a processor 210, control code 220, and a reference frequency 230. The digital control circuit 200 is in communication with the audio input circuit 300 and the mechanical interface circuit 400. The processor 210 acquires sound information provided by the audio input circuit 300, processes the sound information, and determines what signal to communicate to the mechanical interface circuit 400.

For example, in use of the tuning device 100, a musician plays a musical note on the instrument 110. The audio input circuit 300 receives the musical note in the form of a sound wave and converts it into a form appropriate for a digital circuit. The audio input circuit then communicates the converted sound wave to the digital control circuit 200.

The digital control circuit 200 evaluates the converted sound wave to identify its frequency, which it compares to the reference frequency 230. Based on the result of the comparison, the digital control circuit communicates an action to the mechanical interface circuit 400. For example, if the frequency of the converted sound wave is low relative to the reference frequency 230 (or "flat"), then the digital control circuit may communicate a directive to the mechanical interface circuit to move the two sections 112, 114 of the musical instrument 110 closer together in order to increase the frequency of the musical note emitted. If the frequency is high relative to the reference frequency (or "sharp"), the digital control circuit may communicate a directive to move the two sections farther apart.

The processor 210 has at least one input port or connector and at least one output port or connector to interface with the other components of the tuning device. In some implementations, the processor 210 of the digital control circuit 200 is a microprocessor-based component. The processor 210 might be one integrated circuit, such as a microcontroller having integrated electronic peripherals. The processor 210 might be multiple components, such as a discrete microprocessor and other discrete electronic peripherals. The processor 210 might be a programmable logic device, such as a field-programmable gate array (FPGA), with a circuit layout that can vary depending on how the device is configured. The processor 210 might be an application-specific integrated circuit (ASIC), with a static circuit layout. Other implementations of the processor 210 are possible. For example, the processor 210 may be an analog device made up of non-digital electronic components.

The control code 220 may take any of a number of forms, depending on the implementation of the processor 210. If the processor 210 is a microcontroller or a microprocessor, the control code 220 may be written in a programming language or assembly language suited for the particular model of microcontroller or microprocessor. In this form, the control code 220 may be present on a memory device within or accessible by the processor. If the processor 210 is a programmable logic device, the control code may be written in a hardware description language suited for the particular model of device. In this form, the control code 220 may take the form of a configuration of components within the programmable logic device. If the processor 210 is an ASIC, the control code may take the form of the physical layout of the electronic components, such as transistors of the ASIC. Other implementations of the control code 220 are possible.

In some implementations, the reference frequency 230 might be a value permanently integrated into the processor 210. The reference frequency 230 might also be a value available on an optional dynamic medium 235, such as a writeable memory. This allows the reference frequency 230 to be changed, as in the case where a musician chooses a note to tune the musical instrument 110 against using the options provided by the user interface 150, shown in FIG. 1A.

Figure 3:
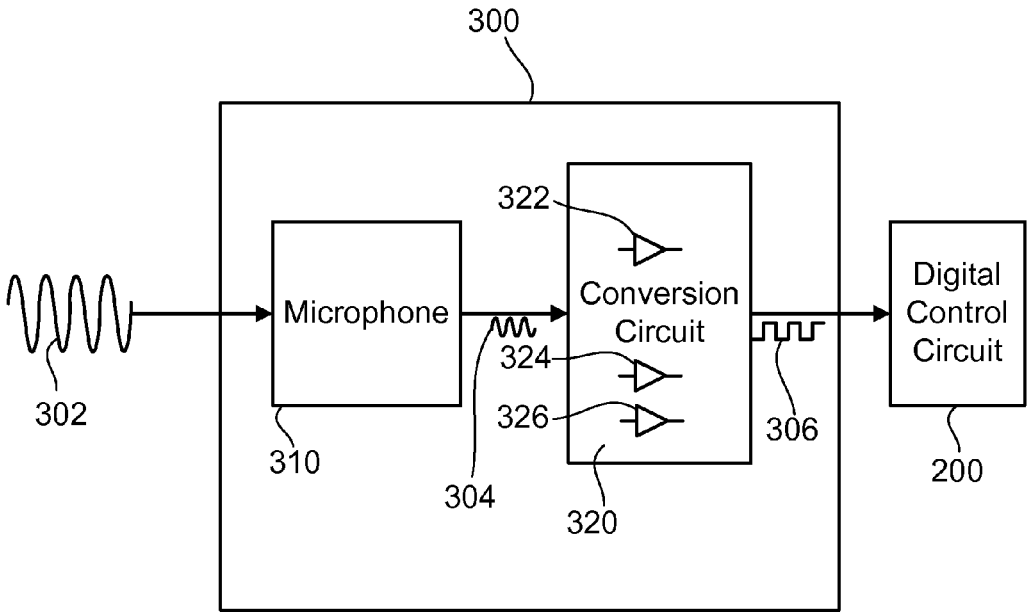
FIG. 3 is a block diagram of an audio input circuit.

FIG. 3 shows the audio input circuit 300. The audio input circuit 300 receives a sound wave 302, such as the sound wave of a single musical note played by a musical instrument, and converts it to a form that can be interpreted by the digital control circuit. The audio input circuit has a microphone 310 that converts the sound wave into an electrical signal 304. Depending on the implementation, any of several types of microphones can be used. For example, the microphone 310 may be a condenser microphone, a dynamic microphone, an electrostatic microphone, a piezoelectric microphone, or another type of microphone or sound input device that is electronically compatible with the audio input circuit 300.

The audio input circuit 300 also has a signal converter 320. The signal converter 320 receives the electrical signal 304 from the microphone 310 and prepares it for transmission in the form of a converted sound wave 306. In some implementations, the converted sound wave 306 will be a square wave. A square wave can be used as an input to a digital circuit, such as the digital control circuit 200. However, the signal converter might provide another kind of converted sound wave 306 rather than a square wave, depending on the requirements of the digital control circuit 200.

In some implementations, the signal converter 320 is made up of several components 322, 324, 326. For example, some of the components 322, 324, 326 may be operational amplifiers. The signal converter 320 might have other components, including simple electronic components such as resistors and capacitors. The simple electronic components might replace the operational amplifiers, or may operate alongside them. In some implementations, the signal converter 320 is one discrete component rather than multiple components. In some implementations, the microphone 310 might be integrated with the signal converter 320, in which case the audio input circuit 300 would be one discrete electronic component.

In some implementations, the signal converter has other functionality. For example, the signal converter might include a frequency filter that removes components of the input sound wave 302 that are outside of a range of expected frequencies.

Figure 4A:
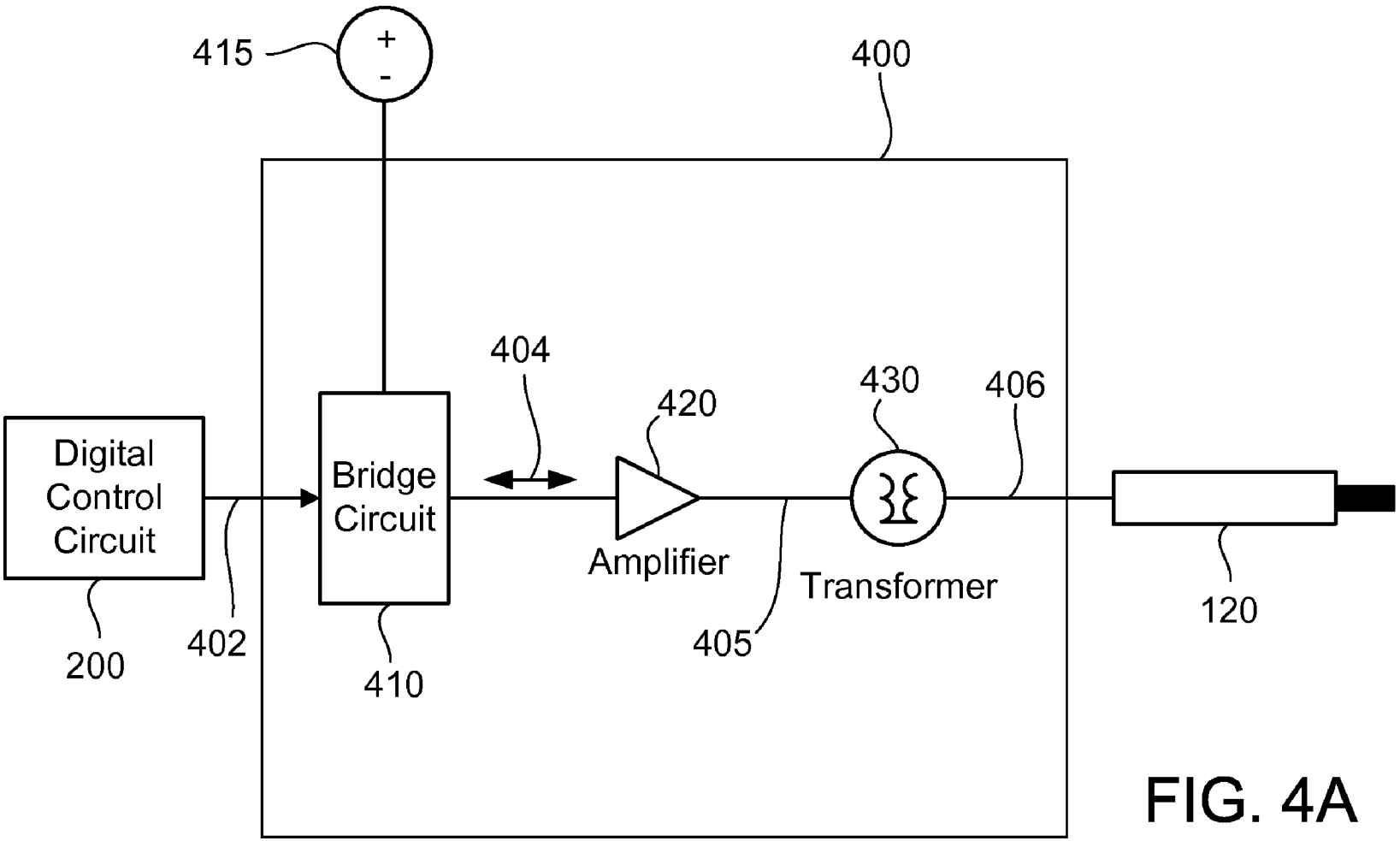
FIG. 4A is a block diagram of a mechanical interface circuit.

FIG. 4A shows the relationship of the components that make up the mechanical interface circuit 400. The mechanical interface circuit 400 receives a control signal 402 from the digital control circuit 200 and applies a driving current 406 to the linear actuator 120. The mechanical interface circuit has a bridge circuit 410 that interprets the control signal 402 and outputs a current 404. The bridge circuit 410 uses the information from the control signal to determine the correct form of the current 404 for manipulating the linear actuator 120. The current originates from a power source 415 connected to the bridge circuit 410. In some implementations, the linear actuator 120 moves its piston 124 outward if a positive current is applied, and inward if a current of opposite polarity (negative current) is applied. When interfacing with this kind of linear actuator 120, the bridge circuit 410 will output a positive or negative current 404, as appropriate. The bridge circuit might be a single electronic component or a combination of electronic components. For example, the bridge circuit might be an H-bridge, which is a component or circuit that can apply either a positive or negative voltage to its output load, depending the state of an input control signal. The digital control circuit 200 is configured to provide the type of control signal expected by the mechanical interface circuit 400 and its components.

In some implementations, the mechanical interface circuit 400 has an amplifier 420. The current 404 output by the bridge circuit 410 might not have sufficient magnitude to power the linear actuator 120. In these cases, the amplifier 420 increases the amperage of the current 404 to a sufficient level, and outputs an amplified current 405. The amplifier 420 may also be directly connected to the power source 415, or another power supply.

In some implementations, the mechanical interface circuit 400 has a transformer 420. The voltage at the output of the amplifier 420 might not be the correct voltage to drive the linear actuator 120. In these cases, the transformer 430 steps the driving current 406 of the mechanical interface circuit 400 to the correct voltage.

Figure 4B:
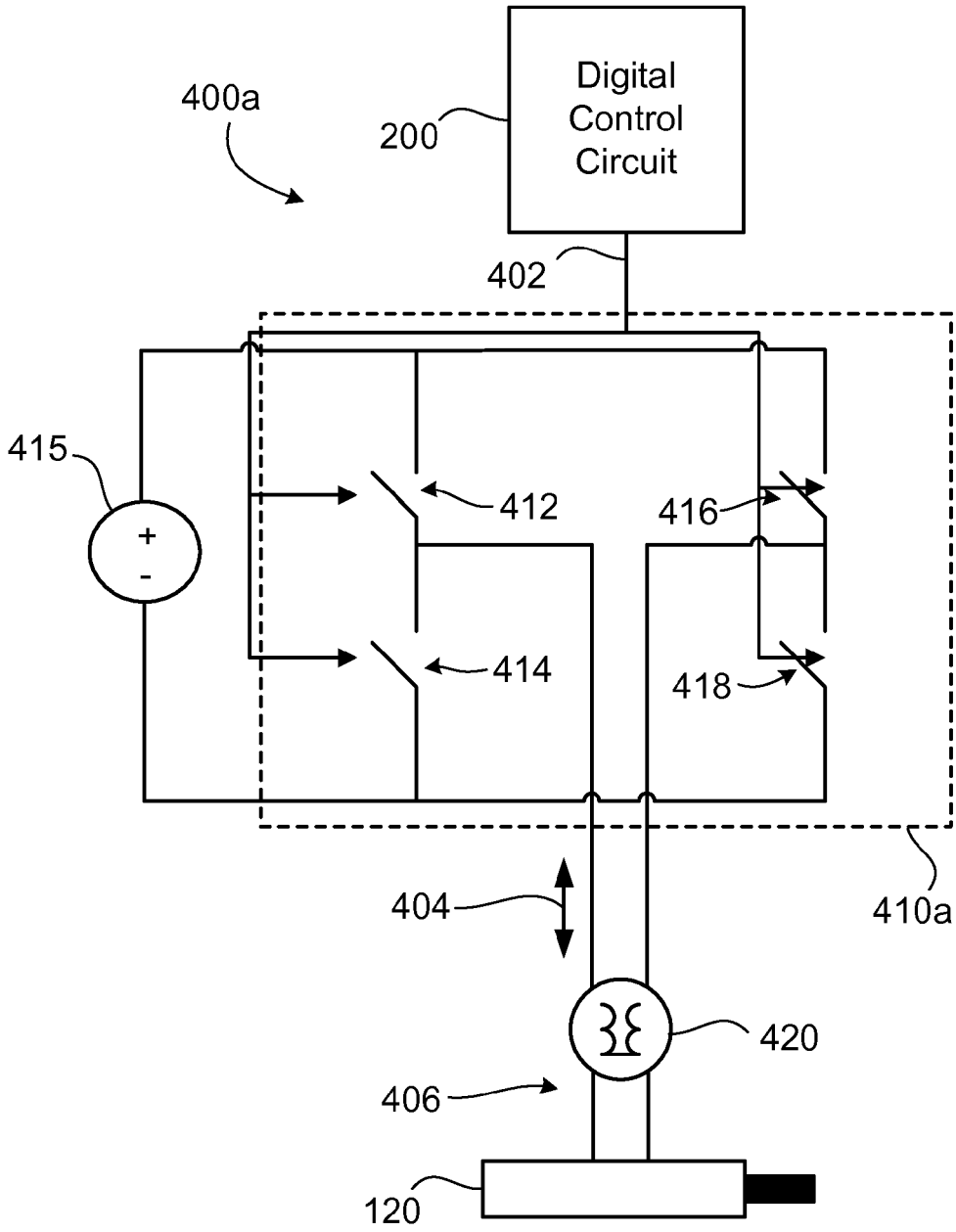
FIG. 4B is a circuit diagram of a mechanical interface circuit.

FIG. 4B shows a circuit diagram of one version of the mechanical interface circuit 400*a*. This version of the mechanical interface circuit 400*a* uses an H-bridge 410*a* as the bridge circuit. The control signal 402 that originates from the digital control circuit 200 turns H-bridge switches 412, 414, 416, 418 on and off to control the direction of the current 404 that originates from the power source 415. This version of the mechanical interface circuit also has the transformer 420 that steps the driving current 406 to a voltage compatible with the linear actuator 120.

Figure 5:
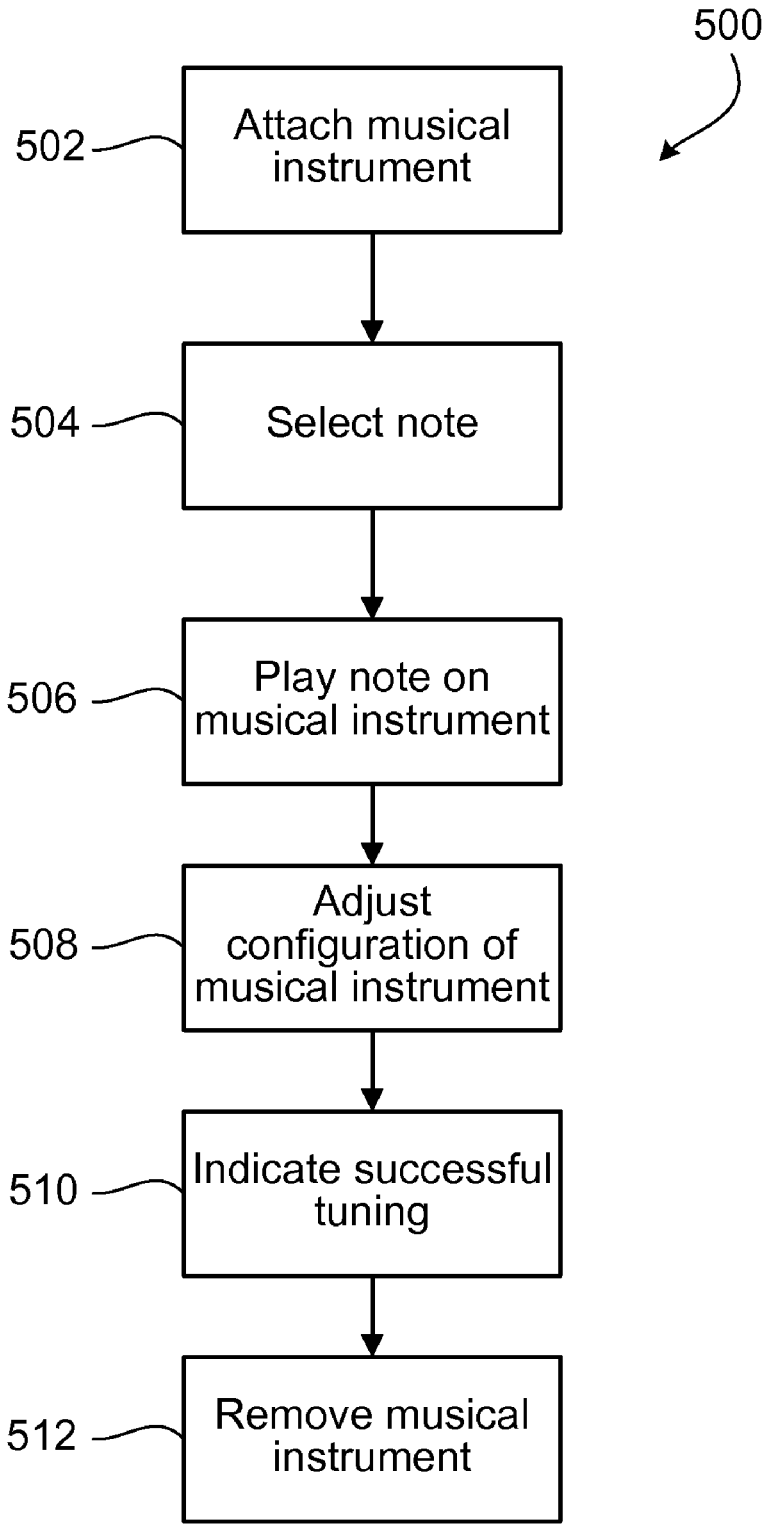
FIG. 5 is a flowchart showing the operation of a flute tuning device.

FIG. 5 shows a flowchart 500 of the procedure for tuning a musical instrument using the tuning device. First, the musician attaches 502 the musical instrument to the tuning device.

Once the musical instrument is securely attached, the musician selects 504 a musical note to play. In some implementations, the tuning device will always be configured to detect the frequency of a particular note. For example, the tuning device might be configured to expect a musician to be playing note "A," and the musician will always choose note "A" to properly tune the instrument. In some implementations, the tuning device may allow the musician to select which note to play on the instrument as part of the tuning process. For example, the musician might use a configuration interface to select a note on the tuning device. In other implementations, the musician might play a note with a different instrument, which the tuning device uses to calculate a desired frequency.

Once the musician has selected a musical note to play, the musician plays 506 the note on the instrument. In response to the note, the tuning device adjusts 508 the configuration of the instrument. If the note is higher in frequency than expected, the tuning device will adjust the instrument to play a lower note, and if the note is lower in frequency than expected, the tuning device will adjust the instrument to play a higher note. Once the instrument has been adjusted to play the note at the proper frequency, the tuning device indicates 510 to the musician that the tuning process has completed successfully and the musician can stop playing the note. The musician may then remove 512 the tuned musical instrument from the tuning device. In some implementations, depending on the characteristics of the musical instrument, the entire process in flowchart 500 may take approximately 3 to 9 seconds.

Figure 6:
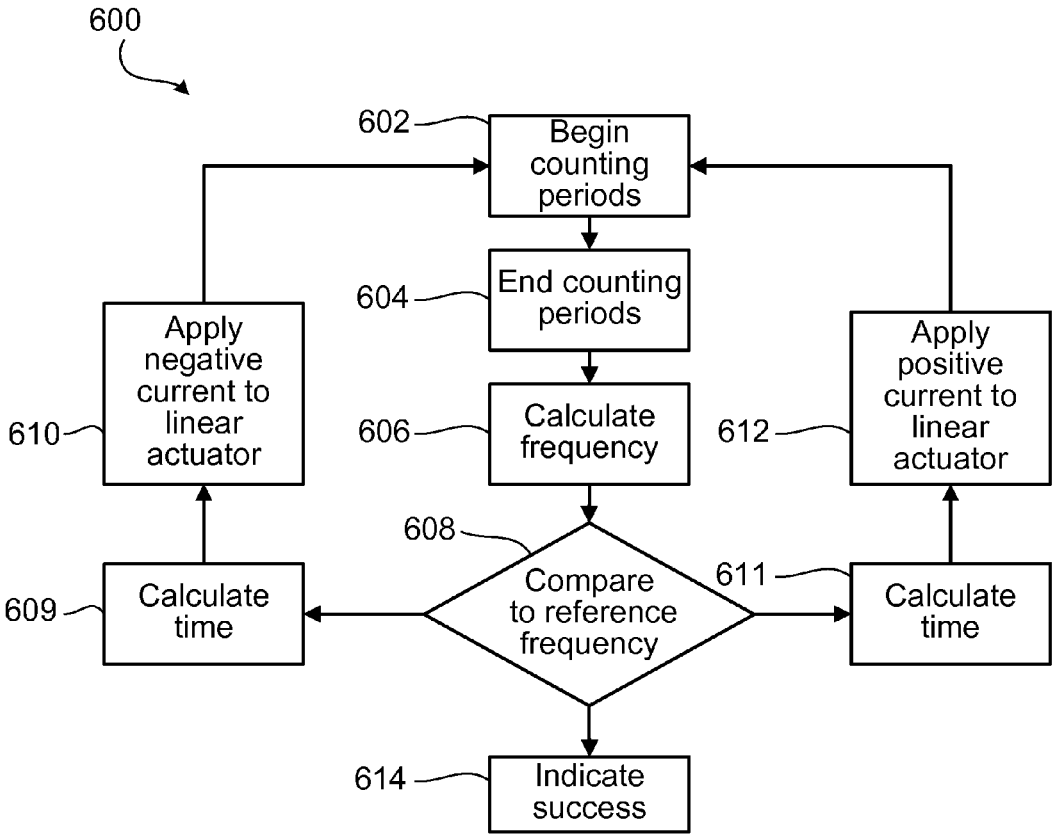
FIG. 6 is a flowchart showing the operation of a flute tuning device.

FIG. 6 shows a flowchart 600 of the operation of the tuning device while it is tuning an instrument. The tuning device first begins 602 counting the number of periods detected in a signal received by way of a microphone or other sound input device. For example, when a musician plays a musical note on the instrument as part of the tuning process, the instrument emits a sound wave. The signal might be the sound wave or a square wave derived from the sound wave. After a period of time, the tuning devices stops 604 counting the periods and calculates 606 the frequency of the signal from the counted periods. For example, if the tuning device has counted 440 periods in one second of counting, the frequency of the signal is 440 Hz, which corresponds to the "A" note on the $4^{th}$ octave used sometimes in tuning a musical instrument.

Next, the tuning device compares 608 the calculated frequency to a reference frequency corresponding to the ideal frequency of the musical note that the musician is playing. For example, the reference frequency might be the 440 Hz of an "A" note. The tuning device takes one of several actions depending on the result of the comparison. If the calculated frequency is lower than the reference frequency, the tuning device calculates 609 the approximate amount of time that the device should engage the linear actuator to bring the sound output of the musical instrument upward in frequency as close as possible to the reference frequency. Then, the tuning device applies 610 a negative current to its linear actuator for that amount of time, which moves the two sections of the musical instrument closer together and causes the instrument to emit a higher frequency. If the calculated frequency is higher than the reference frequency, the tuning device calculates 611 the approximate amount of time that the device should engage the linear actuator to bring the sound output of the musical instrument downward in frequency as close as possible to the reference frequency. Then, the tuning device applies 612 a positive current to the linear actuator for that amount of time to cause the instrument to emit a lower frequency. In either application 610, 612, after the current has been applied, the tuning device again begins 602 counting the periods of the input signal to further evaluate the sound emitted by the musical instrument. The tuning device compares 608 the calculated frequency and the reference frequency as many times as necessary until they close range of each other. For example, if the calculated frequency is only 1 Hz above or below the reference frequency, the musical instrument can be considered fully tuned. Once this occurs, the tuning device indicates 614 that the tuning process has been successful. Other implementations might use other thresholds in the comparison between the calculated frequency and the reference frequency. For example, the musical instrument might be considered fully tuned when the calculated frequency is within a percentage of the reference frequency, such as within one percent of the reference frequency. Some of these implementations might have controls on the user interface 150 for entering a range for the calculated frequency that is considered to be in tune.

As described here, in situations where the tuning device calculates the frequency of the sound emitted from the musical instrument more than one time, the tuning device only applies current to the linear actuator when the tuning device is not measuring the frequency of the sound wave. The operation of the linear actuator may generate a sound that interferes with the sound emitted by the musical instrument. In some implementations, if the sound of the linear actuator is not detectable by the tuning device, or the sound of the linear actuator is filtered out from the input sound wave, then the tuning device can evaluate the sound emitted by the musical instrument while the linear actuator is engaged.

In some implementations, the tuning device uses one of several algorithms for calculating 609, 611 the amount of time to engage the linear actuator. For example, the tuning device might use a static value for the amount of time, and cease the tuning process once the changes in instrument configuration no longer progressively improve the tuning of the instrument. The tuning device might use the difference between the calculated frequency and reference frequency to calculate 609, 611 the amount of time, so that a greater difference results in a greater amount of time. In this example, the tuning device might use a table of stored reference values in the calculation, so that the calculation 609, 611 includes using the difference between the calculated frequency and reference frequency to look up a stored amount of time that, when used, can be expected to bring the instrument to the correct tuning configuration. The look-up process can be repeated as necessary. The tuning device does not need to store data about the musical note played by the musician itself.

Figure 7:
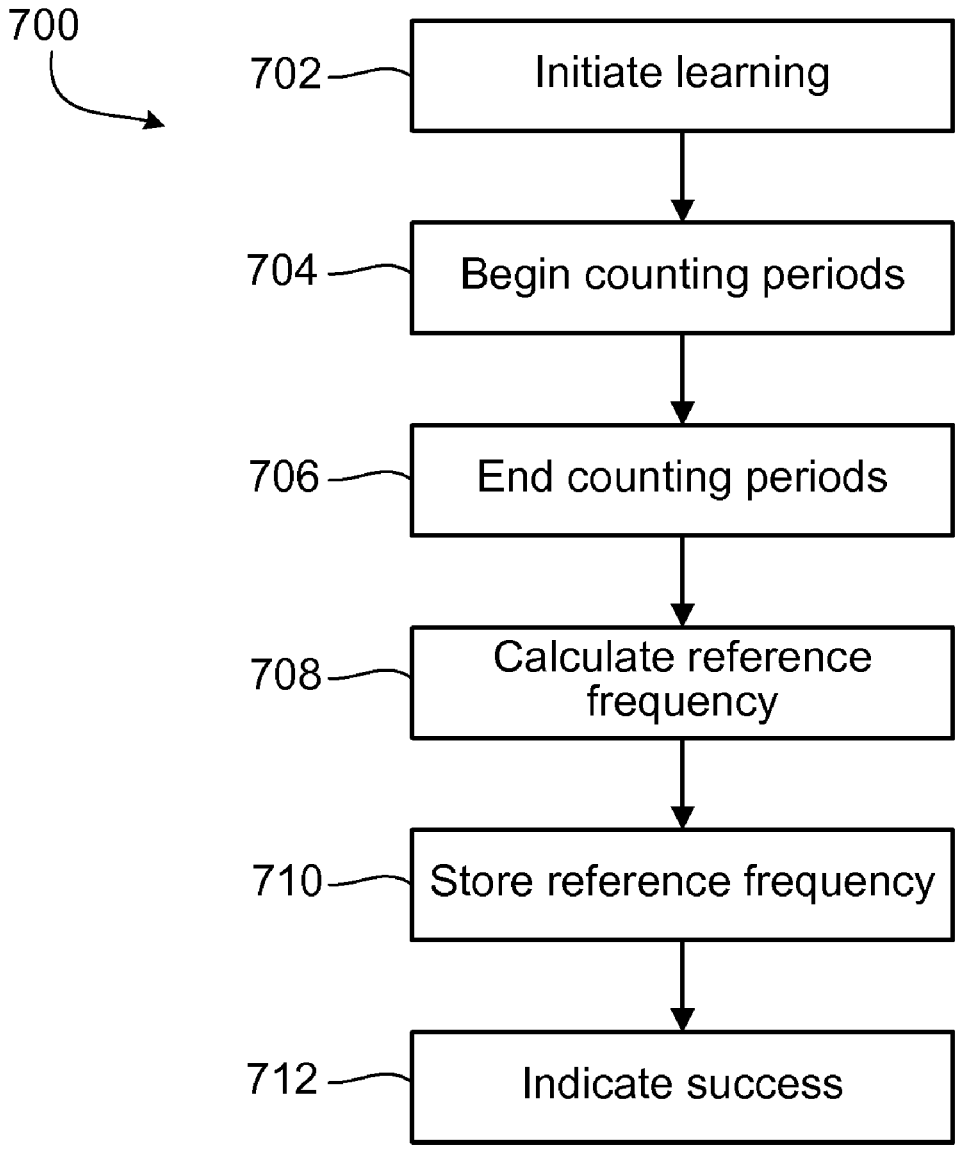
FIG. 7 is a flowchart showing the operation of a flute tuning device.

FIG. 7 shows a flowchart 700 of the operation of a version of the tuning device capable of learning a note played on a musical instrument that can then be used to tune another musical instrument. The tuning device first initiates 702 the learning process, for example, in response to a press of a learn note button. The tuning device begins 704 counting the number of periods detected in a signal received by way of a microphone or other sound input device. After a period of time, the tuning devices stops 706 counting the periods and calculates 708 the frequency of the signal from the counted periods. The tuning device then stores 710 this frequency in a dynamic medium, to be used as the reference frequency. Once this occurs, the tuning device indicates 712 that the learn process has been successful, upon which the musician can tune the musical instrument according to the steps described with respect to FIGS. 5 and 6.

Various implementations of the systems and techniques described here can be realized in digital electronic circuitry, integrated circuitry, specially designed ASICs, computer hardware, firmware, software, and/or combinations thereof.

These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC.

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

A number of embodiments of the invention have been described. Nevertheless, it will be understood that various modifications may be made without departing from the spirit and scope of the invention. For example, some of the steps described above may be order independent, and thus can be performed in an order different from that described.

It is to be understood that the foregoing description is intended to illustrate and not to limit the scope of the invention, which is defined by the scope of the appended claims. For example, a number of the function steps described above may be performed in a different order without substantially affecting overall processing. Other embodiments are within the scope of the following claims.

What is claimed is:

1. A tuning device for a musical wind instrument comprising a first tubular portion and second tubular portion, together defining a musical air passage and disposed in a mutually adjustable relationship for establishing tuning status, the tuning device comprising:

a linear actuator;

a first mounting assembly attached to the linear actuator and adapted for releasable mounting to the first portion of the musical wind instrument to be tuned;

a second mounting assembly attached to the linear actuator and adapted for releasable mounting to the second portion of the musical wind instrument to be tuned;

a sensor for a frequency of a note played on the musical wind instrument;

a comparator of the played frequency to a reference frequency; and a transmitter for issuing a movement signal to the linear actuator for changing spacing between the first and second mounting assemblies to adjust relationship between first and second tubular portions, and for ceasing the movement signal when the comparator determines that the played frequency has approximately matched the reference frequency.

2. The apparatus of claim 1 in which the musical wind instrument is a flute.

3. The apparatus of claim 1 in which the first mounting assembly comprises a first quick-release clamp and the second mounting assembly comprises a second quick-release clamp.

4. The apparatus of claim 1 in which the reference frequency is acquired from another musical instrument.

5. The apparatus of claim 1 in which the reference frequency is selected on a user interface.

6. The apparatus of claim 1 in which the transmitter issues the movement signal for a period of time to alter the frequency of the played note received by the sensor.

7. The apparatus of claim 6 in which the period of time is calculated using the difference between the frequency of the musical note and the reference frequency.

8. The apparatus of claim 1 in which the transmitter issues the movement signal and ceases the movement signal more than once.

9. A method for tuning a musical wind instrument comprising a first tubular portion and second tubular portion, together defining a musical air passage and disposed in a mutually adjustable relationship for establishing tuning status, the method comprising:

releasably mounting a first mounting assembly attached to the linear actuator to the first portion of the musical wind instrument to be tuned;

releasably mounting a second mounting assembly attached to the linear actuator to the second portion of the musical wind instrument to be tuned;

sensing a frequency of a note played on the musical wind instrument;

comparing the played frequency to a reference frequency;

issuing a movement signal to the linear actuator to change spacing between the first and second mounting assemblies to adjust relationship between first and second tubular portions; and ceasing the movement signal when the comparator determines that the played frequency has approximately matched the reference frequency.

10. The method of claim 9 in which the musical wind instrument is a flute.

11. The method of claim 9 in which releasably mounting a first mounting assembly to the first portion of the musical wind instrument comprises mounting the first portion to a first quick-release clamp, and releasably mounting a second mounting assembly to the second portion of the musical wind instrument comprises mounting the second portion to a second quick-release clamp.

12. The method of claim 9, further comprising sensing a frequency of a reference note played on a musical instrument not mounted to the tuning device, and using the frequency of the reference note as the reference frequency.

13. The method of claim 9, further comprising selecting the reference frequency on a user interface.

14. The method of claim 9 in which issuing the movement signal comprises issuing the movement signal for a period of time.

15. The method of claim 14, further comprising calculating the period of time using the difference between the frequency of the played note and the reference frequency.

16. The method of claim 9 in which issuing the movement signal comprises issuing the movement signal more than once.

17. A computer-readable medium storing a computer program for tuning a musical instrument, the computer program including instructions for causing a computer to:

sense a frequency of a note played on a musical instrument to be tuned, a first portion of the musical instrument releasably mounted to a first mounting assembly and a second portion of the musical instrument releasably mounted to a second mounting assembly, both assemblies attached to a linear actuator;

compare the played frequency to a reference frequency;

issue a movement signal to the linear actuator to change spacing between the first and second mounting assemblies to adjust relationship between first and second tubular portions; and cease the movement signal when the comparator determines that the played frequency has approximately matched the reference frequency.

18. The computer-readable medium storing a computer program for tuning a musical instrument of claim 17, the computer program including instructions for causing a computer to tune a musical wind instrument.

* * * * *